United States Patent [19]

Hyner et al.

[11] 3,954,420

[45] May 4, 1976

[54] NON-FERROUS CORROSION RESISTANT UNDERCOATING

[75] Inventors: Jacob Hyner, Waterbury; Stephen Gradowski, Torrington, both of Conn.

[73] Assignee: Whyco Chromium Co., Inc., Thomaston, Conn.

[22] Filed: June 24, 1975

[21] Appl. No.: 589,768

[52] U.S. Cl. ..... 29/183.5; 29/196.3; 29/199; 204/37 R; 204/40

[51] Int. Cl.[2] ..... B32B 15/00

[58] Field of Search ..... 29/183.5, 196.3, 199, 29/196.5; 204/37 R, 40

[56] References Cited

UNITED STATES PATENTS

| | | | |
|---|---|---|---|
| 2,428,318 | 9/1947 | Nachtman | 29/196.3 |
| 2,490,700 | 12/1949 | Nachtman | 204/40 |

*Primary Examiner*—Arthur J. Steiner
*Attorney, Agent, or Firm*—DeLio and Montgomery

[57] ABSTRACT

The present invention provides a method of improving the corrosion resistance of a ferrous metal substrate by providing a non-ferrous corrosion resistant plated undercoating by steps of sequentially plating onto the substrate a first layer of copper of about 0.00015 to 0.0005 inches in thickness, a layer of zinc of about 0.0002 to 0.0005 inches in thickness and a second layer of copper of about 0.00015 to 0.0005 inches in thickness and, optionally, multiples of such zinc and copper layers, and thereafter subjecting the plated substrate to a thermal treatment sufficient to effect partial diffusion at the respective interfaces of each of the layers of copper and zinc to provide zones of non-homogeneous copper-zinc alloy of infinitely variable linear distribution of copper and zinc.

3 Claims, 3 Drawing Figures

NON-FERROUS CORROSION RESISTANT UNDERCOATING

BACKGROUND OF THE INVENTION

The present invention pertains to the field of metal plating and, more specifically, to a method for applying a non-ferrous plated undercoating to a ferrous metal substrate to provide improved corrosion resistance, while facilitating conventional top-plating thereupon, and to the novel non-ferrous plated undercoating provided thereby.

In the art of metal plating, it has been well known and generally recognized that the corrosion resistance of ferrous metal substrates, as well as the adherence of conventional top-plating metals thereto, can be significantly improved by provision of various undercoatings thereupon.

Perhaps the most simple such undercoating known in the art is a single plated layer of a non-ferrous metal, such as zinc, cadmium, nickel or brass, which is selected for use based upon the particular application to be made of the substrate article. In some applications, metals such as zinc or cadmium are utilized to provide "sacrificial plates," in that they protect the metal by themselves being preferentially corroded, instead of the ferrous metal substrate. In other applications, plates of metals such as nickel and brass are utilized as "barrier plates," which form an impervious layer that, for a reasonable time, can prevent penetration of corroding agents in the atmosphere or environment to which the coated substrate is exposed.

As the art developed, various modifications of the single plate type coating developed. For example, one of these modifications involved use of a dual nickel coating in which the lower layer has one type of crystalline structure, while the upper layer comprises nickel of yet another crystal structure. There have also been refinements involving provision of three separate layers of nickel.

Another improvement has been the utilization of a micro-porous layer of nickel and chromium to spread the potential on the surface and prevent pits from forming. The use of multiple plated layers of various metals is also known in the art. For example, during the period of the Korean War in which nickel became scarce, it was found that brass could be utilized as an undercoating substitute for all, or part, of nickel. In this regard, white brass, which is a high zinc content homogeneous alloy of copper and zinc, was found to provide a degree of protection above and beyond that available from pure barrier-type protection. Thus, it was realized that combination of sacrificial layers such as zinc, cadmium or brass with copper, nickel or chromium could be accomplished to provide improved performance.

One of the more recent developments in the field has been the provision of a barrier/sacrificial type plate to be utilized on articles of a ferrous metal, such as fastening devices, for example, nuts and bolts and various sundry parts for motor vehicles. This type of coating generally utilizes a barrier-layer of cadmium, cadmium-tin alloy, or a layer of cadmium and a layer of tin, and is typically deposited over a copper strike on the ferrous metal substrate, followed by a "sacrificial" layer, such as zinc, followed by a second layer of copper, and, finally, a conventional topcoating, such as nickel or chromium. While this type of undercoating provides improved corrosion resistance, it has disadvantages in that the resulting undercoating contains a metal of considerable toxicity, namely cadmium, which is also quite soft and malleable. These disadvantages are the source of difficulties both in manufacture and in use of the plated articles by the consumer.

Thus, in the present state of the art, it is known that brass, a homogeneous alloy of copper and zinc, can be utilized as such, for "barrier plate" type protection against corrosion of an underlying ferrous metal. However, the prior art contemplates only the use of the well-known homogeneous brass alloys, such as red brass, yellow brass, white brass or the like. Thus, while several U.S. patents, namely U.S. Pat. Nos. 2,115,749 (Rubin), 2,392,456 (Brown) and 2,490,700 (Nachtman), disclose use of a layer of brass on a ferrous substrate, they specifically indicate that a homogeneous brass alloy must be utilized. While each of these patents describes a somewhat different method of forming brass on the ferrous substrate by application of adjacent layers of copper and zinc, followed by the application of heat to cause alloying, each clearly discloses formation of a homogeneous alloy of a specific, uniform composition of copper and zinc resulting from complete diffusion (Nachtman) or complete alloying (Rubin and Brown) of the serially plated layers of copper and zinc. Yet the prior art has failed to discover the superior advantages and corrosion resistance provided by the multi-layer undercoating of the present invention comprising a novel combination of sacrificial and barrier type protection utilizing zinc and a novel zone of non-homogeneous copper-zinc alloy.

SUMMARY OF THE INVENTION

In accordance with the present invention, a novel method is provided to impart superior corrosion resistance to a ferrous metal substrate by application of a novel non-ferrous plated undercoating. The method comprises sequential plating of a layer of copper, followed by layers of zinc and copper, or multiples thereof, and thereafter subjecting the plated substrate to a thermal treatment sufficient to produce zones of non-homogeneous copper-zinc alloy of infinitely variable linear copper-zinc distribution at the interfaces of the sequentially plated layers. The novel non-ferrous plated undercoating provided by the present invention is characterized as a multi-layer, barrier/sacrificial type undercoating system comprising a first layer of copper plated on the substrate, a first zone of non-homogeneous copper-zinc alloy of infinitely variable linear distribution of copper and zinc contiguous with the first layer of copper, a layer of zinc contiguous with the first zone of the non-homogeneous copper-zinc alloy, a second zone of the non-homogeneous copper-zinc alloy contiguous with the first layer of zinc, and a second layer of copper contiguous with the second zone of non-homogeneous copper-zinc alloy.

It is a primary object of the present invention to provide a useful method for imparting superior corrosion resistance to a ferrous metal substrate, while facilitating conventional topcoating thereupon.

It is also a primary object of the present invention to provide a novel non-ferrous plated undercoating for a ferrous metal substrate which will provide superior corrosion resistance and facilitate topcoating by providing a harder and more adherent undercoating than currently available from conventional undercoatings.

It is a further object of the present invention to provide a non-ferrous plated undercoating capable of allowance for a wide variation of the undercoating thickness to facilitate strict control for varying engineering applications.

It is a further object of the present invention to provide a non-ferrous plated undercoating capable of minimizing crystal defects and discontinuities, so as to effect elimination of corrosion sites therein.

It is a further object of the present invention to provide a method for effecting long acting galvanic protection of a ferrous metal substrate and to provide a non-ferrous plated undercoating capable of providing such protection.

It is yet a further object of the present invention to provide a method for imparting superior corrosion resistance to a ferrous metal substrate which avoids use of toxic metals, such as cadmium or its alloys and to provide a non-ferrous plated undercoating in which such toxic metals are totally absent.

It is yet a further object of the present invention to provide ferrous metal articles of manufacture having a conventional topcoat plating and possessing superior corrosion resistance.

Other objects and advantages of the method and non-ferrous plated undercoating of the present invention will be readily apparent to those skilled in the art through the study of the following description of the preferred embodiments and the appended claims.

In the drawings:

FIG. 1 is an enlarged diagrammatic cross-sectional view of a ferrous metal substrate, shown in section, coated with sequential layers of copper, zinc, and copper, prior to subjection thereof to thermal treatment in accordance with the present invention.

FIG. 2 is a view similar and in relative juxtaposition to FIG. 1, showing the ferrous metal substrate after having been subjected to thermal treatment in accordance with the present invention, whereby intermediate zones of non-homogeneous copper-zinc alloy of infinitely variable linear copper-zinc distribution have been formed at the respective interfaces of the sequentially plated layers of copper, zinc, and copper.

FIG. 3 is a graph representing the relative distribution of copper to zinc composition of the non-ferrous plated undercoating of FIG. 2, shown in relative juxtaposition thereto.

DETAILED DESCRIPTION

Figure 3:
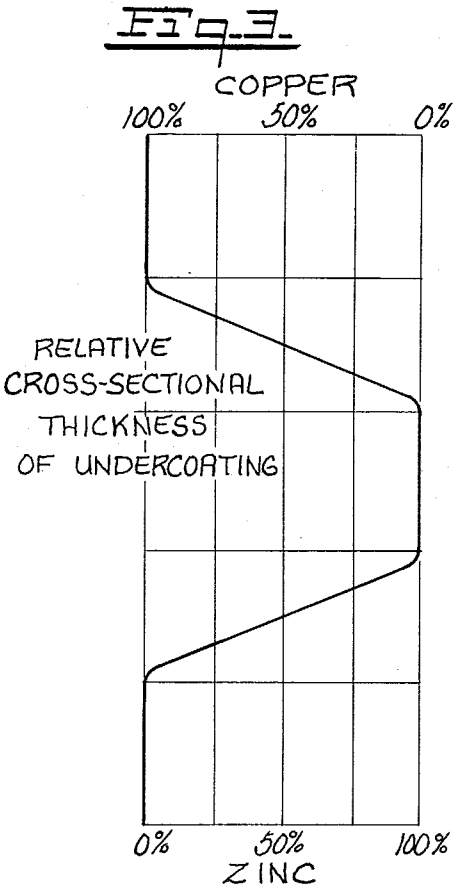

The metal substrate upon which the novel non-ferrous plated undercoating of the present invention can be applied is a ferrous metal, or any alloy thereof. For example, iron or steel are most preferably utilized.

A first layer of copper metal 1 is plated directly over the surface of the substrate 10. While the thickness of the layer of copper 1 is dependent upon the desired thickness of the zone of non-homogeneous copper-zinc alloy of the present invention to be thereafter formed, it is preferable that the layer of copper 1 range between about 0.00015 to 0.0005 inches. It has been found that generally a thickness of about 0.0003 inches will provide maximum effectiveness.

Next, a layer of zinc 2 is plated over the first layer of copper 1. While, likewise, the thickness of the layer of zinc 2 is dependent upon the desired thickness of the zone of non-homogeneous copper-zinc alloy to be thereafter formed, preferably the thickness of the layer of zinc 2 should range from about 0.0002 to about 0.0006 inches in thickness. If the layer of zinc 2 is of insufficient thickness, a homogeneous brass alloy may be advertently produced upon subsequent thermal treatment and, thus, diminish significantly the capacity of the resulting non-ferrous plated undercoating to provide superior corrosion resistance, due to elimination of the definitive layer of zinc, sandwiched between and contiguous to zones of non-homogeneous copper-zinc alloy of infinitely variable linear distribution of copper and zinc, which constitutes the principal inventive feature of the present invention. In fact, it is the discovery of such a novel non-ferrous plated undercoating which possesses the capability to provide superior corrosion resistance that is the underlying principle of the present invention.

Finally, a second layer of copper 3 is plated over the layer of zinc 2. Again, the thickness of the second layer of copper 3 is dependent upon the desired thickness of the non-homogeneous copper-zinc alloy to be thereafter formed, but preferentially is within the range of about 0.00015 to 0.0005 inches. The second layer of copper 3 is necessary for proper formation and performance of the novel non-ferrous plated undercoating of the present invention. If insufficient copper is applied over the layer of zinc 2, upon subsequent thermal treatment it may be totally exhausted in the formation of a zone of non-homogeneous copper-zinc alloy and thus diminish the degree of corrosion resistance provided thereby. On the other hand, there is no definitive maximum limitation on the thickness of the layer of copper 3 which can be applied, although economic considerations are generally determinative.

Optionally, additional layers of zinc and copper, sequentially applied in the manner and thickness of the layer of zinc 2 and second layer of copper 3, can be plated over the second layer of copper 3, in accordance with the present invention. Likewise, any number of multiples of these additional layers of zinc and coppper can be utilized within the purview of the present invention and to the extent necessary to provide the desired degree of corrosion resistance.

After completion of the foregoing plating steps, the plated substrate is subjected to a thermal treatment sufficient to initiate linear diffusion at the respective interfaces of the various layers of copper and zinc and to thereafter sustain such linear diffusion so as to produce respective zones of non-homogeneous copper-zinc alloy of infinitely variable linear distribution of copper and zinc ranging in composition, by weight, of from less than 100% copper and more than 0% zinc to more than 0% copper and less than 100% zinc. However, it is a critical limitation of the present invention that the thermal treatment not be carried to an extent which would result in complete diffusion or complete alloying of the copper and zinc to form a homogeneous brass alloy. Accordingly, formation of a homogeneous brass alloy is to be strictly avoided in the practice of the present invention for the reason that the corrosion resistance provided thereby is inferior to that provided by the non-homogeneous copper-zinc alloy of the present invention.

For purposes of the present invention, it is to be understood that the term "homogeneous alloy" is used to denote an alloy of uniform composition in terms of the ratio of parent metals and concentrations thereof on a macro scale. Furthermore, it is also to be understood that use of the term "non-homogeneous alloy" is intended to mean and is restricted to an alloy which is not of uniform composition on a macro scale, although at isolated sites throughout the alloy, micro-homogenization of the parent metals will, of course, occur. Thus, in a "non-homogeneous alloy" on the macro scale, the concentrations of the parent metals will be variable throughout.

As indicated previously, the thickness of the various zones of non-homogeneous copper-zinc alloy formed by the thermal treatment is variable and can be selected in the practice of the present invention, as it is a function of the time and temperature of the thermal treatment, which may be expressed as follows:

$$D = (f(E))\,(f(T)),$$

where $D$ equals thickness in inches of a zone of non-homogeneous copper-zinc alloy, $E$ equals the temperature and $T$ equals the time of the thermal treatment.

The temperature, $E$, is preferably chosen within the range of 100°–700°F (37.8°–371.0°C), although it is within the purview of the present invention that a somewhat higher or lower temperature may be utilized. In any event, the temperature utilized should not exceed the melting point of the substrate, nor any of the metals applied thereto.

Likewise, for purposes of the present invention the time required for the thermal treatment may range between about 0.5 to 30.0 hours and, preferably, between about 2.5 to 20.0 hours. Since the time is also a function of the temperature utilized, it is selected in conjunction therewith to provide the desired thickness of the zone of non-homogeneous copper-zinc alloy.

A conventional topcoat plating may be applied over the non-ferrous plated undercoating of the present invention and may comprise any of the conventional plating materials known in the art, including but not limited to nickel, chromium, brass, gold. or the like. It is to be understood for purposes of the present invention that the conventional topcoat may be applied either before or after the aforementioned thermal treatment. Considerations determinative of the sequence of the thermal treatment and topcoating may include, or example, the effect of the thermal treatment on the topcoat, as well as manufacturing and economic considerations, as determined within the discretion of those practicing the present invention.

Figure 2:
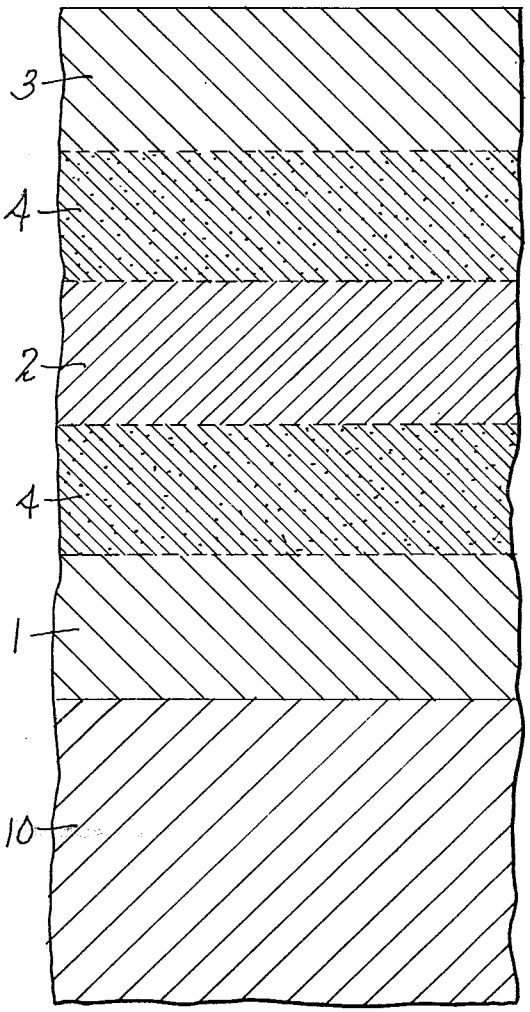
Figure 1:
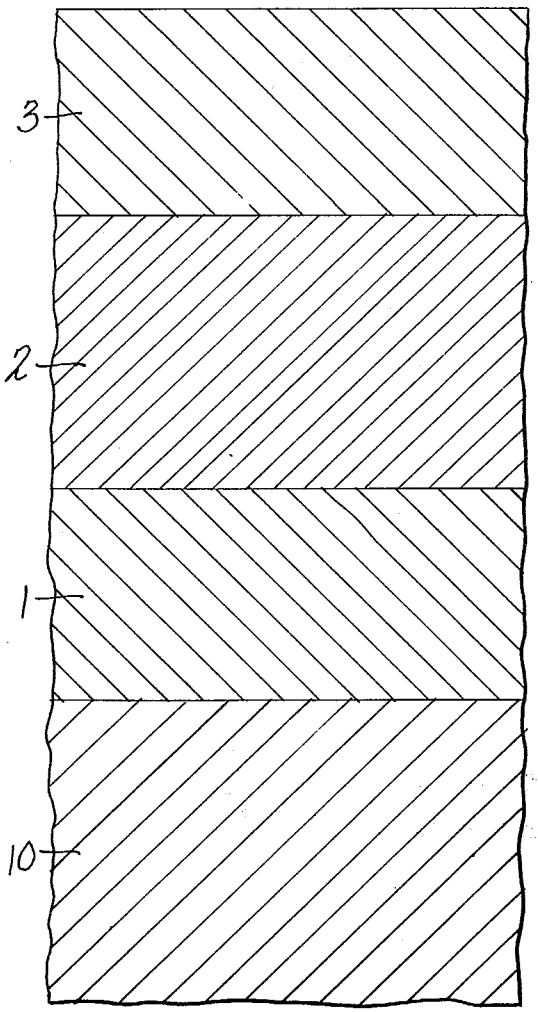

In accordance with the foregoing method of the present invention, a novel non-ferrous plated undercoating is formed on the ferrous metal substrate 10 as illustrated in FIG. 2. The non-ferrous plated undercoating comprises, sequentially, a first layer of copper 1 plated on substrate 10, a zone of non-homogeneous copper-zinc alloy 4 of infinitely variable linear distribution of copper and zinc contiguous with the first layer of copper 1, a layer of zinc 2 contiguous with the aforementioned underlying and an overlying zone of non-homogeneous copper-zinc alloy 4 and a second layer of copper 3 contiguous with the zone of non-homogeneous copper-zinc alloy 4 overlaying the layer of zinc 2.

In the event that any optionally available additional layers of zinc and copper, or multiples thereof, are applied in accordance with the present invention, it is, of course, to be understood that the non-ferrous plated undercoating will further comprise an additional zone of non-homogeneous copper-zinc alloy contiguous with the second layer of copper 2, an additional layer of zinc contiguous with both an underlying and overlying zone of non-homogeneous copper-zinc alloy and an additional layer of copper contiguous with the zone of non-homogeneous copper-zinc alloy overlying the additional layer of zinc, or multiples thereof.

It is within the purview of the present invention that while the sequential organization of the constituent layers of zones comprising the non-ferrous plated undercoating of the present invention must be maintained, wide variation is permissible with regard to the relative linear dimensions of each of the constituent layers and zones. Specifically, each zone of non-homogeneous copper-zinc alloy may be provided in any thickness desired, with the only effective restraint thereupon determined by the effective linear dimensions of the contiguous layers of copper and zinc being utilized. Thus, the minimum thickness of each zone of non-homogeneous copper-zinc alloy should generally exceed 0.00001, while the maximum thickness cannot exceed a dimension which would require substantial exhaustion of either of the contiguous layers of copper and zinc in the formation of the zone of non-homogeneous alloy. However, it is preferable that the thickness of each zone of non-homogeneous copper-zinc alloy should range between about 0.000035 to 0.000052 inches.

Each zone of non-homogeneous copper-zinc alloy provided in accordance with the present invention may be characterized as having an infinitely variable, linear distribution of copper and zinc, which is illustrated in FIG. 3 and is shown in relative juxtaposition and scale to the non-homogeneous copper-zinc alloy illustrated in FIG. 2. Accordingly, the vertical axis of FIG. 3 is intended to correspond to the relative cross-sectional thickness of the undercoating of the present invention shown in FIG. 2, while the horizontal axis designates the compositional ratio, in terms of percentage by weight, of copper to zinc throughout the non-ferrous plated undercoating.

As FIG. 3 indicates, there exist zones contiguous with the layers of substantially pure copper and zinc in which the distribution of copper and zinc varies in relation to the relative cross-sectional linear dimension (i.e., thickness) of the undercoating. It should be noted that for purposes of the present invention, the term "linear" is used to indicate a dimension, rather than to designate a 1:1 mathematical relationship. For example, the usage of the phrase "linear distribution" with regard to the compositional ratio in the zone of non-homogeneous copper-zinc alloy is not intended to connotate that there is a strict linear relationship therebetween in the mathematical sense, although such may be the case. In this regard, it is also within the purview of the present invention that the mathematical relationship descriptive of the compositional ratio of copper and zinc throughout the zone of non-homogeneous copper-zinc alloy may be non-linear in the mathematical sense.

Functionally, the non-homogeneous copper-zinc alloy of the present invention provides superior corrosion resistance, as well as improved facilitation of topcoating. The non-homogeneous alloy provides an improved "barrier layer" in the non-ferrous plated undercoating of the present invention, in that potential sites of corrosion are eliminated by virtue of the micro-homogenization of the copper and zinc, so as to prevent formation of concentration or galvanic cells. Such sites of corrosion include crystal defects and discontinuities which may otherwise exist at the interface between layers of copper and zinc. The application of conventional topcoat plates is facilitated by the non- ›mogeneous copper-zinc alloy as a result of the high tegrity of bonding which it provides between the ated layers of copper and zinc, as well as the im-oved hardness and strength over the parent metals, pper and zinc.

One further advantage offered by the non-homo-neous copper-zinc alloy of the present invention is its n-toxicity achieved by avoidance of toxic metals, ch as cadmium. Thus, the non-ferrous plated under-ating of the present invention can be utilized in appli-tions wherein toxicity is of concern to the consumer. Therefore, in accordance with the foregoing descrip-n of the present invention, a novel non-ferrous ıted undercoating is provided which improves the rrosion resistance of the underlying substrate, in dition to facilitating topcoating thereupon. The supe-r corrosion resistance appears to be a synergistic ect, resulting from the formation of the non-homo-neous copper-zinc alloy of the present invention, er that which would be expected or anticipated from ıomogeneous brass alloy, such as those previously own and utilized in the art. Without being limited, or ıerwise restricted, to any one theory or explanation the superior corrosion resistance provided, it never-less appears that this may be a result of the gradual ear transition between the copper and "sacrificial er" of zinc which is provided by the novel "barrier er" of non-homogeneous coper-zinc alloy of the sent invention. Furthermore, it has been found that ıximum performance can be achieved by a non-fer-ıs plated undercoating of the present invention hav-; multiple layers, as well as thicker zones of non-mogeneous copper-zinc alloy.

EXAMPLE 1 n accordance with the method of the present inven-n, copper was electroplated onto a steel surface to a ckness of about 0.003 inches Next, zinc was electro-ted over the layer of copper to form a layer of zinc ɔut 0.0006 inches in thickness. Thereafter, a layer of ɔper was electroplated over the layer of zinc to a ckness of about 0.0003 inches. Finally, a thin top-ıt of nickel was plated over the outer layer of cop-.

The plated steel was then heated to 83°C and held at t temperature for 20 hours, during which time the ckness of the zone of non-homogeneous copper-zinc ɔy was measured periodically and found to be as lows:

| Time (Hrs.) | Thickness of Non-Homogeneous Alloy (Inches) |
|---|---|
| 2.5 | 0.00007 |
| 5.0 | 0.00010 |
| 20.0 | 0.00011 |

ıfter the thermal treatment was completed, standard SS tests for corrosion resistance were conducted on plated steel. The protection against corrosion was nd to be in excess of 100 hours.

EXAMPLE 2

ınother steel article was plated with successive lay-of copper, zinc and copper, followed by the thin coating of nickel, in the same manner as in Example However, the thermal treatment to which the plated el was then subjected comprised a temperature of 225°C, which was maintained for 20 hours. Periodic measurement of the thickness of the zone of non-homogeneous copper-zinc alloy which was formed indicated the following:

| Time (Hrs.) | Thickness of Non-Homogeneous Alloy (Inches) |
|---|---|
| 2.5 | 0.00022 |
| 5.0 | 0.00078 |
| 20.0 | 0.00104 |

CASS tests were again conducted on the steel article to which the non-ferrous plated undercoating of the present invention had been applied and again corrosion resistance in excess of 100 hours was verified.

As indicated previously and as will be readily apparent to one skilled in the art, various modifications may be made in the details of the method of the present invention to provide the non-ferrous plated undercoating having a composition which may vary in accordance with the present invention. For example, various methods of plating the copper and zinc layers may be utilized, including but not limited to electroplating, electroless-plating and other conventional application techniques. Also, it is fully within the purview of the present invention that the application of thermal energy to achieve and maintain the required temperature for thermal treatment may be provided by any practical method, either direct or indirect. Finally, it is fully within the purview of the present invention that the form of the substrate to which the undercoating may be applied can comprise any article of manufacture made therefrom, which will benefit from the superior corrosion resistance provided by the present invention.

What is claimed is:

1. A non-ferrous plated undercoating for providing improved corrosion resistance and facilitating top-plating to a ferrous metal substrate comprising:

a. a first layer of copper plated on said substrate;
b. a first zone of non-homogeneous copper-zinc alloy of inifinitely variable linear copper-zinc distribution contiguous with said first layer of copper;
c. a layer of zinc contiguous with said first zone of said non-homogeneous copper-zinc alloy;
d. a second zone of non-homogeneous copper zinc alloy of infinitely variable linear copper-zinc distribution contiguous with said layer of zinc; and
e. a second layer of copper contiguous with said second zone of said non-homogeneous copper-zinc alloy, said non-homogeneous copper-zinc alloy of infinitely variable linear copper-zinc distribution ranging in composition, by weight, of from less than 100% copper and more than 0% zinc to more than 0% copper and less than 100% zinc, wherein the thickness of each of said layers of copper range between about 0.00015 to 0.0005 inches, the thickness of said layer of zinc ranges between about 0.0002 to 0.0006 inches and the thickness of each of said zones of non-homogeneous copper-zinc alloy is greater than 0.00001 inches.

2. A non-ferrous plated undercoating for providing improved corrosion resistance and facilitating top-plating to a ferrous metal substrate comprising:

a. a first layer of copper plated on said substrate;
b. a first zone of non-homogeneous copper-zinc alloy of infinitely variable linear copper-zinc distribution contiguous with said first layer of copper;

c. a layer of zinc contiguous with said first zone of said non-homogeneous copper-zinc alloy;

d. a second zone of non-homogeneous copper zinc alloy of infinitely variable linear copper-zinc distribution contiguous with said layer of zinc; and e. a second layer of copper contiguous with said second zone of said non-homogeneous copper-zinc alloy, said non-homogeneous copper-zinc alloy of infinitely variable linear copper-zinc distribution ranging in composition, by weight, of from less than 100% copper and more than 0% zinc to more than 0% copper and less than 100% zinc, wherein each of said layers of copper is about 0.00004 inches in thickness, said layer of zinc is about 0.00008 inches in thickness, and each of said zones of non-homogeneous copper-zinc alloy is about 0.000052 inches in thickness.

3. In a ferrous metal article of manufacture, having a conventional metallic topcoat and possessing high corrosion resistance, the improvement comprising the non-ferrous plated undercoating of claim 1.

* * * * *

UNITED STATES PATENT AND TRADEMARK OFFICE

CERTIFICATE OF CORRECTION

PATENT NO. : 3,954,420

DATED : May 4, 1976

INVENTOR(S) : Jacob Hyner and Stephen Gradowski

It is certified that error appears in the above-identified patent and that said Letters Patent are hereby corrected as shown below:

Column 5, line 40, after "include", "or" should read --for--.

Column 6, line 23, "0.000052" should read --0.00052--.

Column 7, (the first word of each line thereof), line 1, "mogeneous" should read --homogeneous--.
line 2, "tegrity" should read --integrity--.
line 3, "ated" should read --plated--.
line 4, "oved" should read --proved--.
line 5, "pper" should read --copper--.
line 7, "neous" should read --geneous--.
line 8, "n-toxicity" should read --non-toxicity--.
line 9, "ch" should read --such--.
line 10, "ating" should read --coating--.
line 11, "tions" should read --cations--.
line 13, "n" should read --tion--.
line 14, "ated" should read --plated--.
line 15, "rrosion" should read --corrosion--.
line 16, "dition" should read --addition--.
line 17, "r" should read --rior--.
line 18, "ect" should read --effect--.
line 19, "neous" should read --geneous--.
line 20, "er" should read --over--.
line 21, "omogeneous" should read --a homogeneous--.
line 22, "own" should read --known--.
line 23, "erwise" should read --otherwise--.
line 24, "the superior" should read --for the superior--.
line 25, "less" should read --theless--.
line 26, "ear" should read --linear--.
line 27, "er" should read --layer--.
line 28, "er" should read --layer--.

UNITED STATES PATENT AND TRADEMARK OFFICE

CERTIFICATE OF CORRECTION

PATENT NO. : 3,954,420

DATED : May 4, 1976

INVENTOR(S) : Jacob Hyner and Stephen Gradowski

It is certified that error appears in the above-identified patent and that said Letters Patent are hereby corrected as shown below:

Column 7 (continued),
line 29, "sent" should read--present--.
line 30, "ximum" should read --maximum--.
line 31, "s plated" should read --rous plated--.
line 32, "multiple layers" should read --ing multiple layers--.
line 33, "mogeneous" should read --homogeneous--.

Column 7 (after "Example 1"),
"n" should read --In--.
"n" should read --tion--.
"ckness" should read --thickness--.
"ted" should read --plated--.
"out" should read --about--.
"oper" should read --copper--.
"ckness" should read --thickness--.
"at" should read --coat--.
insert --per.--
"he" should read --The--.
"t" should read --that--.
"ckness" should read --thickness--.
"oy" should read --alloy--.
"lows:" should read --follows:--.

Column 7 (after the table),
"fter" should read --After--.
"SS" should read --CASS--.
before "plated" insert --the--.
"nd" should read --found--.

UNITED STATES PATENT AND TRADEMARK OFFICE

CERTIFICATE OF CORRECTION

PATENT NO. : 3,954,420 (Page 3 of 3)

DATED : May 4, 1976

INVENTOR(S) : Jacob Hyner and Stephen Gradowski

It is certified that error appears in the above-identified patent and that said Letters Patent are hereby corrected as shown below:

Column 7 (after "Example 2"),
"nother" should read --Another--.
"of copper" should read --ers of copper--.
"coating" should read --topcoating--.
Before "However," insert --1.--.
"el" should read --steel--.

Column 7, line 28, "coper-zinc" should read --copper-zinc--.

Column 7, line 39, "0.003" should read --0.0003--.

Column 10, line 6, "0.000052" should read --0.00052--.

Signed and Sealed this

Third Day of August 1976

[SEAL]

*Attest:*

RUTH C. MASON
*Attesting Officer*

C. MARSHALL DANN
*Commissioner of Patents and Trademarks*